US005138717A

United States Patent [19]

Tolton

[11] Patent Number: 5,138,717

[45] Date of Patent: Aug. 18, 1992

[54] OUTER GARMENT SUITABLE FOR ATHLETIC ACTIVITIES

[76] Inventor: Gary A. Tolton, 162 Lombard Rd., Red Lion, Pa. 17356

[21] Appl. No.: 708,169

[22] Filed: May 31, 1991

[51] Int. Cl.[5] ..... A41B 7/00

[52] U.S. Cl. ..... 2/123; 2/82; 2/269; 2/270

[58] Field of Search ..... 2/82, 108, 123, 125, 2/269, 270

[56] References Cited

U.S. PATENT DOCUMENTS

| | | | |
|---|---|---|---|
| 1,751,832 | 3/1930 | Menzin | 2/123 |
| 1,921,467 | 8/1933 | Hymes | 2/123 |
| 2,022,878 | 12/1935 | Berger | 2/123 |
| 2,112,788 | 6/1937 | Rosenberg . | |
| 2,299,982 | 10/1942 | Harrison | 2/269 |
| 2,322,451 | 8/1943 | Jones . | |
| 2,398,258 | 4/1946 | Seegal . | |
| 2,670,471 | 3/1954 | Kaufman | 2/269 |
| 2,846,686 | 8/1958 | Tames . | |
| 3,843,972 | 10/1974 | Weinkle | 2/123 |
| 4,038,698 | 8/1977 | Smith | 2/82 |
| 4,241,461 | 12/1980 | Jolly | 2/123 |
| 4,543,670 | 10/1985 | Ehring | 2/270 |
| 4,631,753 | 12/1986 | Ehring | 2/270 |
| 4,896,379 | 1/1990 | Kape | 2/269 |
| 4,897,886 | 2/1990 | Grilliot | 2/82 |

*Primary Examiner*—Werner H. Schroeder
*Assistant Examiner*—Diana L. Biefeld
*Attorney, Agent, or Firm*—Hoffman, Wasson & Gitler

[57] ABSTRACT

An athletic garment with an outer shell which is lightweight, waterproof, and porous having a "piston and cylinder" cuff arrangement to insure unrestricted movement of the arms of the wearer. A resilient insert which serves as a return mechanism is sewn between the shell and a tubing wristlet. A non-resilient gusset serves as a cylinder cuff stop mechanism. The insert and gusset cooperate to furnish the wearer with an extra five to six inches of cuff extension without having the sleeve ride-up the arm of the wearer.

5 Claims, 4 Drawing Sheets

OUTER GARMENT SUITABLE FOR ATHLETIC ACTIVITIES

FIELD OF INVENTION

This invention relates broadly to an outer garment, such as a jacket, suitable for golfers, runners, hunters, etc. More particularly, this invention relates to refinements in the cuffs defined on the sleeves of such garments, and in the adjustable liner with a resilient insert, joined to the exterior shell of such garment.

BACKGROUND OF THE INVENTION

There has been a long standing need for an outer garment, such as a jacket, that could be worn under different climatic conditions for diverse athletic activities. Such garment would enable the wearer to perform strenuous exercises, without having the sleeves of the jacket "ride-up" along the arms of the wearer, or the body of the jacket "gather-up" or "bunch-up", in unsightly, bulky, restricting, gatherings of excess material. While neither the sleeve movement nor the gathering of excess material is a significant problem to the average person, under normal conditions, such distractions are magnified in significance when the wearer is engaged in an event requiring skill and concentration. Thus, the slightest shifting of the sleeves of the garment may distract the golfer from successfully addressing a golf ball, or a hunter from shooting his prey, or a skier from executing a turn, or a tennis player from returning a hard hit ball, etc.

Additionally, the outer garment must be capable of being worn under diverse climatic conditions, so that the owner of such garment can wear same for several months of the year, in mild weather and in seasonably cold weather, with equal comfort. The outer garment must achieve its suitability for diverse athletic activities without sacrificing its attractiveness for casual wear, thus appealing to a wide segment of the purchasing public.

Manifestly, the objectives stated above have been addressed by numerous clothing designers over the years, and with varying degrees of success. In order to obtain adequate warmth for outdoor wear, one has had to accept bulky fabrics, which interfered with athletic activities, at least in some instances. In other approaches, exotic light-weight materials have been utilized that have priced the resulting outer garment at such a level that only the very well-to-do can afford to purchase same.

One attempt to address the conflicting demands placed upon the designer and/or manufacturer of outer garments for athletic purposes is shown in U.S. Pat. No. 2,112,788, granted Mar. 29, 1938, to Gordon W. Rosenberg. Such patent discloses an outer garment, such as a golfing jacket, that provides a maximum degree of freedom for the upper part of the wearer's body, while still maintaining a neat appearance. Rosenberg relies upon an elastic lining 7, 8 within the garment. The elastic lining, as noted in column 1, lines 19–33 of Rosenberg, urges the sleeves to a normal position relative to body 1 of the garment, and maintains the sleeves in such position until the wearer's arms or shoulders are moved. Cross-stitched connections 9 between sleeves 2 and extensions 5, and pleats 15 defined between the rear panel 8 of lining 7 and back section 1 of the garment, further enhance the ability of the wearer to move his arms and shoulders relatively freely.

The outer garment disclosed by Rosenberg, and by numerous others, appreciated that the outer garment might well be made in two major components, namely, an outer shell comprising the body with the sleeves secured thereto, and a resilient, light-weight liner. The outer shell could be formed of a material, such as leather or cloth, that would resist the cold weather, while the liner would fit about the body of the wearer. The liner could be made of a porous mesh material for comfort.

Although the elastic liner 7, 8 used in the garment disclosed in Rosenberg permitted the shoulder and back to expand, the sleeves, which lacked cuffs, would tend to shift on the arms of the wearer; such shifting would be accentuated whenever the wearer moved his arms in a swinging manner. Also, the liner 7, 8 was not adjustable, and would not always fit snugly about the body of the wearer.

Thus, it should be noted that no known outer garment has been able to satisfactorily address the oft-times conflicting demands of suitability for wear under different climatic conditions, diverse athletic endeavors requiring different movements of the arms, individualized fit, and reasonable cost. To the extent that such demands may be met by a single outer garment, and not by a collection of outer garments designed solely for one activity, such as golfing, or tennis, etc., the present invention represents a novel clothing design neither disclosed, nor suggested, by the prior art designers and/or manufacturers.

SUMMARY OF THE INVENTION

Thus, with the deficiencies of known outer wear garments clearly in mind, the present invention contemplates an outer garment that is suitable for wear by athletes participating in all kinds of strenuous activities, and under widely varying climatic conditions. The present invention relies upon an outer shell that is light-weight, waterproof, and has a porosity that allows perspiration vapor to escape, and a resilient, mesh-like inner liner that can be adjusted to fit snugly about the body of the wearer.

The present invention relies upon a novel "piston and cylinder" cuff arrangement to insure maximum movement of the arms of the wearer without encountering irksome restriction of movement of the sleeves of the garment. A resilient insert, sewn between the shell and the ribbed tubing that serves as a wristlet, serves as a return mechanism movement. A non-resilient gusset serves as a cylinder cuff stop mechanism. The insert and gusset cooperate to furnish the wearer of the garment with an extra five to six inches of cuff extension without having the sleeve ride-up the arm of the wearer.

The present invention further relies upon a unique liner that comprises a resilient back panel situated between a pair of front panels; the relationship of the back panel to the front panels may be altered by adjustable fasteners. The liner may be adjusted circumferentially, within the confines of the outer shell of the garment to which it is secured, and thus customize the garment to the contours of the body of the wearer.

By virtue of the cooperative interaction of the piston-and-cylinder cuffs on the sleeve, the adjustable liner with its resilient, centrally located panel, the shell and liner interaction, and other structural relationships, the present invention realizes a comfortable, aesthetically pleasing outer garment, suited for wear under different climatic conditions, and equally suitable for wear for divergent athletic activities, such as golf, tennis, skiing, running, hunting, driving, and the like.

The liner comprises a resilient rear panel that is operatively associated with opposing side panels; each side panel is sewn into the outer shell. Snap fasteners enable the resilient rear panel to be adjusted relative to the side panels so that the garment will fit closely about the chest and stomach of the wearer. A resilient band at the lower edge of the back of the outer garment anchors the outer garment on the body of the wearer when the closures on the front of the garment are operated.

Unique cuffs are defined at the free end of each sleeve joined to the shell of the body. A cylindrical section of A cylindrical section, formed of the same material as the shell of the garment, is sewn onto the free end of the sleeve. A gusset is sewn between the outer end of the cylindrical section and the inner end of the ribbed tubing that functions as a wristlet. An insert of resilient material is sewn between the shell and the inner end of the ribbed tubing. When the wearer initially swings his arms, the gusset unfolds and allows the ribbed tubing to move two or three inches outwardly relative to the sleeve, in a passive, unopposed fashion. If the swinging motion continues, the ribbed tubing moves relative to the gusset and may extend five to six inches beyond its initial, "home" position. The resilient insert defines the limit of movement for the ribbed tubing, and acts as a return spring therefor. The ribbed tubing may thus be extended five to six inches relative to the sleeve, a considerable distance. The ribbed tubing is cylindrical in shape, so that it conforms to the wrist of the wearer at all times. Such capability allows the wearer to swing his arms vigorously without the sleeves tugging at his wrists, or otherwise impeding his movements. Such freedom of movement is particularly desirable when playing golf or tennis, or skiing, or hunting, where even the slightest distraction can be annoying and irksome.

BRIEF DESCRIPTION OF THE DRAWINGS

FIG. I is a front elevational view of an active-wear jacket constructed in accordance with the principles of the present invention, such jacket being shown in its closed position.

DETAILED DESCRIPTION OF THE INVENTION

Figure 1:
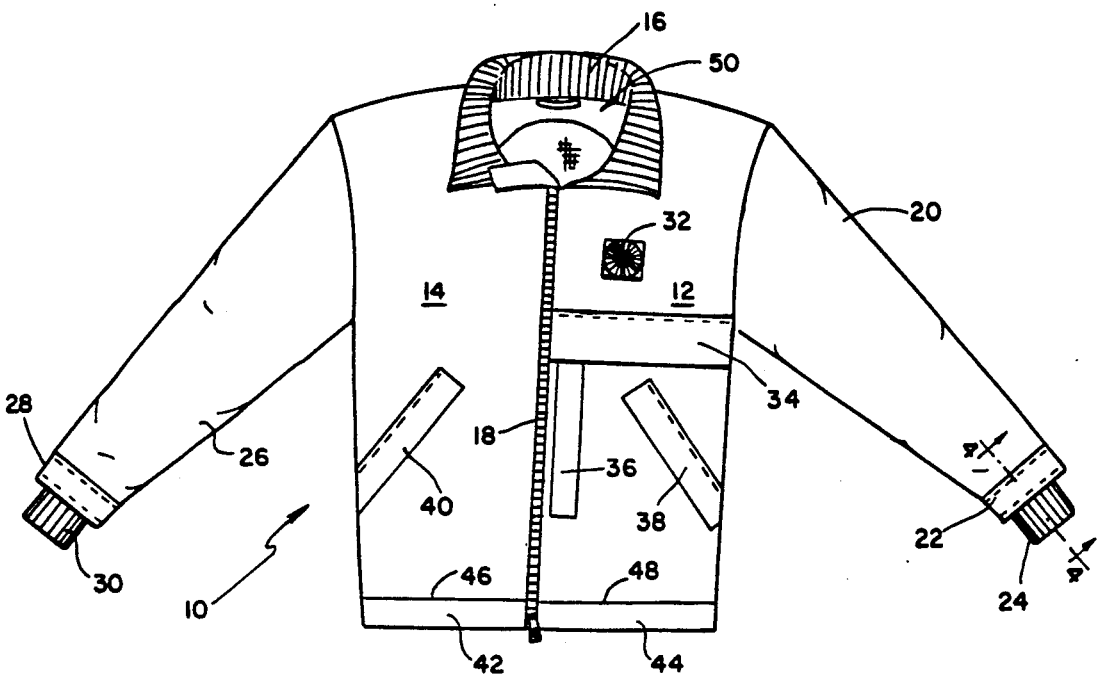

Referring now to the drawings, FIG. 1 shows an activewear jacket 10 constructed in accordance with the principles of the invention. Jacket 10 comprises an outer shell that is lightweight, waterproof, and has sufficient porosity to allow perspiration vapor to escape; one commercially available material that fits these criteria is a texturized polyester two-layer film, manufactured by G.L. Gore and Associates, Inc., of Elkton, Md. 21921-0729 under the mark GORE-TEX. Jacket 10 includes a first front panel 12, of a second front panel 14, and a collar 16 that extends about the neck of the wearer. A zipper 18, when operated, secures the panels 12, 14 together. A first sleeve 20 is secured to the body of the jacket in the area of intersection with panel 12; a cuff 22 is defined at the free end of first sleeve 20, and a wristlet 24 extends beyond the cuff 22. A second sleeve 26 is secured to the body of the jacket in the area of intersection with panel 14; a cuff 28 is defined at the free end of sleeve 26, and a wristlet 30 extends beyond the cuff 28.

A decorative logo 32 is emblazoned on panel 12, and a flap 34 extends horizontally across the panel. A vertically oriented flap 36 protects the entrance into a deep pocket defined between the panel 12 and the inner liner of the jacket, while a diagonally extending flap 38 protects the entrance into another pocket.

Another diagonal flap 40, on panel 14, protects the entrance into yet another pocket. The lower end of panel 14 terminates in a bottom section 42 of folded-over fabric, while the lower end of panel 12 terminates, similarly, in a bottom section 44 of folded-over fabric. The upper limit 46 of section 42 is indicated by a line of stitches, and the upper limit 48 of section 44 is indicated by a line of stitches. A segment of the inner liner of the jacket is visible in the vicinity of collar 16 in FIG. 1; the inner liner is indicated generally by reference numeral 50.

Figure 2:
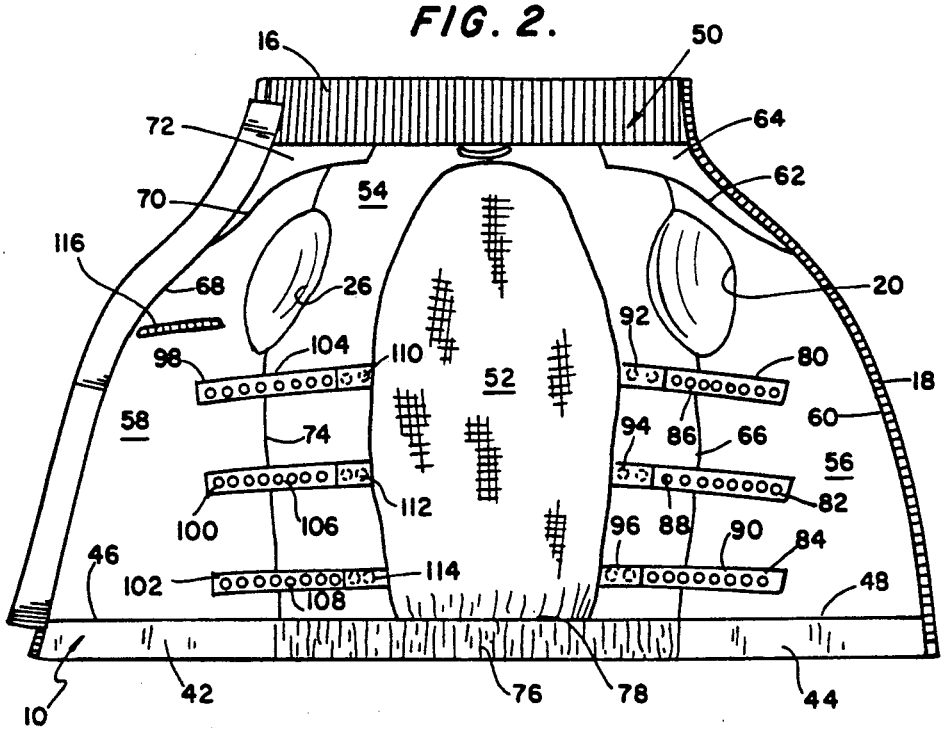
FIG. 2 is a front elevational view of the jacket of FIG. 1, such jacket being shown in its opened condition to expose the liner used with the jacket.

FIG. 2 depicts jacket 10, in its opened condition, wherein zipper 18 has been unzipped, and panels 12, 14 have been folded back to reveal the details of inner liner 50. Liner 50 comprises a central, resilient, insert 52 that yields readily in all directions, a back panel 54, a first side panel 56, and a second side panel 58. Panels 54, 56 and 58 are all formed of a porous, mesh-like material. However, while insert 52 is fashioned from a readily yieldable material, panels 54, 56, and 58, are fashioned from a different, durable, but unyielding material. Consequently, insert 52 can be deformed relative to the supporting panels to which it is secured by sewing. Insert 52, which resembles an inserted U-shaped area, is sewn, or otherwise set, into the back panel 54 of the inner liner 50 of jacket 10. Insert 52 contacts the back of the wearer of the jacket. A suitable insert has proven to be a 100% Dacron material.

One edge of first side panel 56 of the inner liner is sewn into engagement with the inner surface of panel 12 along stitch line 60; line 60 is located inwardly of zipper 18 and indicates the joinder of the zipper to the body of the jacket and side panel 56 of the liner. Side panel 56 is also secured to front panel 12 along line 48. Since side panel 56 of the liner is secured to the front panel 12 of the jacket, and vice versa, the shell and the inner liner of the jacket move in concert.

Side panel 56 is also sewn along diagonal line 62 to interior tab 64 in the vicinity of the collar; the interior tab is made from the same material as the outer shell of the jacket. Side panel 56 and rear panel 54 of the liner are joined together by sewing along vertical line 66, which intersects the opening into sleeve 20.

One edge of second side panel 58 is sewn into engagement with the inner surface of panel 14 along stitch line 68. Line 68 is located inwardly of the zipper and indicates the joinder of the zipper to the body of the jacket and side panel 58 of the liner. Side panel 58 is also secured to front panel 14 along line 46. Since side panel 58 of the liner is secured to the front panel of the jacket, and vice versa, the shell and the inner liner of the jacket move in concert.

Side panel 58 is also sewn along diagonal line 70 to interior flap 72 in the vicinity of the collar; the interior tab is made from the same material as the outer shell of the jacket. Side panel 58 and rear panel 54 of the liner are joined together, by sewing along vertical line 74, which intersects the opening into sleeve 26.

An elastic section 76 is situated at the lower end of the back of the jacket, and such section fits between bottom sections 42 and 42. Section 76 is secured to the lower edges of the insert 52 and rear panel 54 of the inner liner.

Three, parallel, cloth straps 80, 82 and 84 extend horizontally across side panel 56 and rear panel 54 of the inner liner. Several receptacles 86 extend across the width of strap 80, several receptacles 88 extend across the width of strap 82, and several receptacles 90 extend across the width of strap 90. Snap buttons 92 are located on the end of strap 80 closest to insert 52, snap buttons 94 are located on the end of strap 82 closest to insert 52, and snap buttons 96 are located on the end of strap 84 closest to insert 52. Each strap is individually adjustable, by the simple expedient of pressing the snap fastener into the selected ones of the receptacles on the same strap.

In a similar fashion, three parallel cloth straps 98, 100 and 102 extend horizontally across side panel 58 and rear panel 54 of the inner liner. Several receptacles 104 extend across the width of strap 98, several receptacles 106 extend across the width of strap 100, and several receptacles 108 extend across the width of strap 102. Snap buttons 110 are located on the end of the strap 98 closest to insert 52, snap buttons 112 are located on the end of strap 100 closest to insert 52, and snap buttons 114 are located on the end of strap 102 closest to insert 52. Each strap is individually adjustable. An inner pocket 116 is formed in the inner liner, between the liner and the shell of the jacket.

Figure 3:
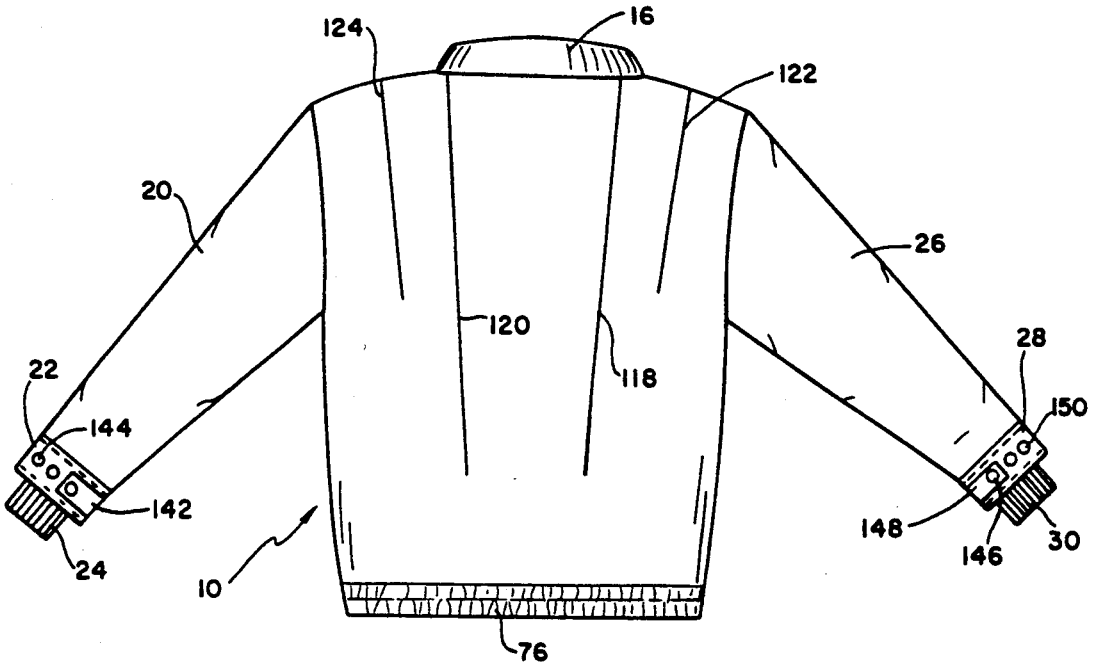
FIG. 3 is a rear elevational view of the jacket of FIG. 1, such jacket being shown in its closed condition.

FIG. 3 illustrates the back of the jacket 10. Elongated central pleats 118, 120 are formed on opposite sides of the back of the jacket, and shorter pleats 122, 124 are formed in the vicinity of the shoulders of the jacket. The pleats expand to allow freer movement of the shoulders and sleeves of the jacket relative to the body of the jacket.

Figure 4:
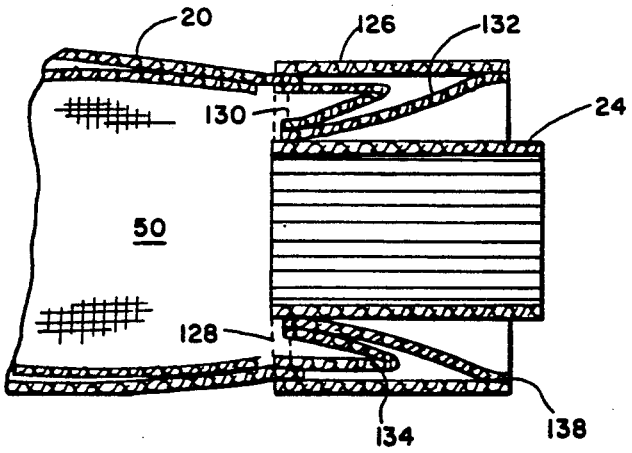
FIG. 4 shows, on an enlarged scale, the unique "false" cuff construction found at the end of each sleeve of the instant active-wear jacket; such view is taken along the line 4—4 in FIG. 1 and in the direction indicated.

FIG. 4 is a cross-sectional view taken through a fragment of one of the sleeves of the jacket, near the free end thereof. Although the cross-sectional view is taken through sleeve 20 along line 4—4 in FIG. 1, and in the direction indicated, it is noted that sleeve 26 is configured in an identical fashion. The cross-sectional view is taken on a far-larger scale than the views of FIGS. 1-3.

A cuff 22 is formed at the free end of sleeve 20, and a wristlet 24 projects beyond the cuff. Wristlet 24 is formed of a ribbed fabric tubing that engages the wrist of the wearer of the jacket. The inherent resiliency of the fabric tubing causes the wristlet to snugly engage the wrist of the wearer, and the length of the wristlet is chosen to insure that the cuff does not ride over the wrist of the wearer.

Cuff 22, upon further inspection, might be considered to be a "false" cuff, for the cuff, although made of the same material as the shell of the jacket, is not formed, in the conventional manner, by folding over the free end of the sleeve. In fact, cuff 22 is a cylinder 126 of the same porous, waterproof material as the shell, and is sewn onto the free end of the sleeve 20 of the shell, along annular stitch lines 128 and 130. Cylinder 126 is usually two and a half inches in length.

Sleeves 20, 26 are lined for maximum comfort by extending liner 50 for the length of each sleeve. The liner reaches to the free end of each sleeve stopping short of the "false" cuff and is joined to the outer shell of the jacket as shown in FIG. 4. A gusset 132, formed of the same porous, waterproof material as the shell of the jacket, extends between the free end of cylinder 126 and the inner end of the wristlet 24. One end of gusset 132 is sewn, or otherwise secured, to cylinder 126, while the other end of gusset 132 is sewn, or otherwise secured, to wristlet 24. Gusset 132 permanently attaches the wristlet 24 to cylinder 126.

A resilient band 134, is sewn between the cylinder 126 and wristlet 24. The resilient band may be formed of the same yieldable, mesh-like resilient material as the insert 52 for the inner liner 50. The flexible band may elongate between two and a half and three inches in axial length, when needed. Also, as shown in FIG. 4, the resilient band may have a loop formed therein, such loop allowing unimpeded movement of the wristlet before the loop unfurls and the band exerts a resistive force upon the wristlet. Additionly, the gussets 132, 134 conceal the resilient bands from view, further enhancing the visual appeal of the outer garment. The gussets are fabricated from the same material as the outer shell, and isolate the interior of the jacket from the external climatic conditions.

Figure 5:
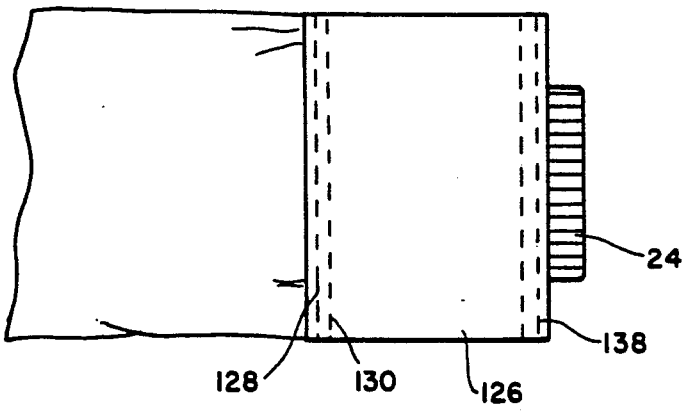
FIG. 5, 6, and 7 show, in sequence, different stages in the movement, and extension of the "false" cuff relative to the end of the sleeve.
Figure 6:
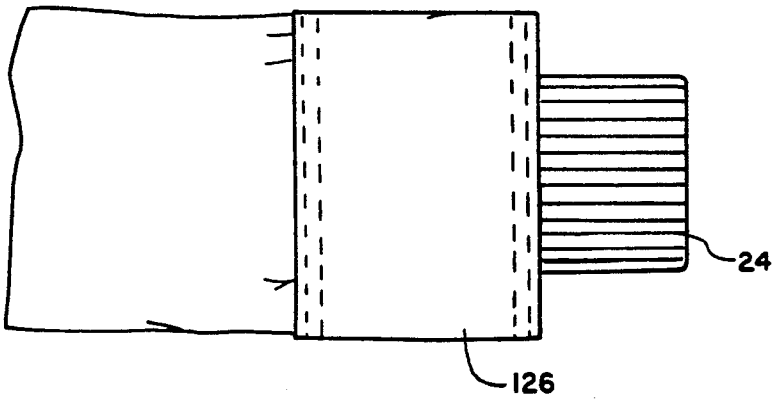
Figure 7:
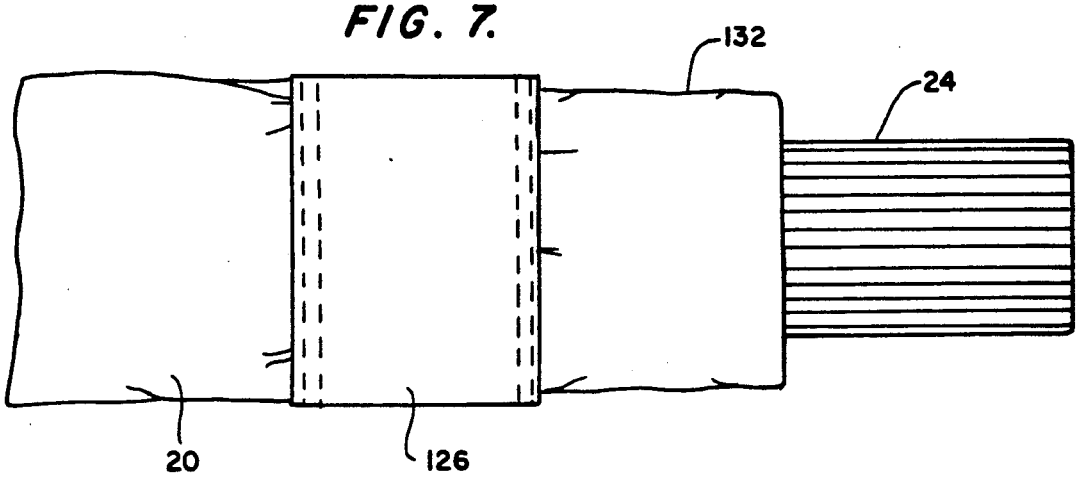

FIGS. 5-7 show, in sequence, the manner in which the cuff, or "false" cuff, of FIG. 4 functions. The functioning may be analogized to a piston-and-cylinder operation, with the cylinder 126 performing its usual role, and the wristlet 24 corresponding to the piston moving relative to the cylinder. FIG. 5 shows the free end of the sleeve 20 with the "false" cuff 22 secured thereto, and a fraction of wristlet 24 projecting therefrom. This view shows the sleeve, cuff and wristlet, in their normal position, the position assumed when the wearer places the jacket on his body, adjusts the inner liner relative to the shell by adjusting internal straps 86, 88, 90, 98, 100, 102 as needed, and closes zipper 18 on the jacket. Elastic section 76 on the lower edge of the jacket, and wristlets 24, 26, anchor the jacket on the body of the wearer.

FIG. 6 shows an intermediate position of movement for the wristlet 24 relative to "false" cuff 22. In such intermediate position, the wristlet has traveled outwardly relative to cylinder 126, as the wearer of the jacket starts to swing his arm(s), or undertake some other vigorous exercise. The gusset 132 (not visible in FIGS. 5 and 6) is turned inside out by the travel of wristlet 24; the gusset does not interfere with the initial travel of the wristlet 24.

FIG. 7 shows the extreme position of movement for the wristlet 24 relative to "false" cuff 22. In such extreme position, the wristlet has traveled further outwardly relative to cylinder 126, as the wearer of the jacket completes the swinging motion of his arms. As an illustrative example, a golfer wearing the jacket would be following through on his swing, and the wristlet 24 would continue to move during the backswing, downswing, and follow-through phases of a drive. As wristlet 24 continues its movement towards its limit of travel, resilient band 134 (shown in FIG. 4), exerts a restraining force upon wristlet 24. Such restraining force urges the wristlet back to the intermediate position adopted in FIG. 6. The bias of the inherent resiliency of band 134 provides an active restraint upon the movement of wristlet 24.

Wristlet 24 is capaable of two and a half to three inches of unrestricted travel before gusset 132 is turned inside out, and resilient band 134 comes into play, as suggested by a comparison of FIGS. 5 and 6. Wristlet 24 is capable of an additional two-three inches of travel, against the urging of restraining band 134, before the wristlet reaches its limit of travel. Thus, in total, wristlet 124 is capable of a minimum of five inches of travel, and a maximum of six inches of travel, before the resistive force of band 134 exceeds the opposing force produced by the swinging movement of the arms of the user. The turning inside-out of the gusset, allows two and a half to three inches of passive movement, while the stretching of restraining member 134 serves as an active restraint allowing two-three inches of additional travel. The significant extent of travel of wristlet 24, and wristlet 30, allows the jacket 10 to be worn comfortably, without having the sleeves interfere, or "ride-up" the arms of the wearer, despite divergent exercises and athletic movements attributable to diverse sports and activities.

SUMMARY OF OPERATION

The manner of utilizing the jacket 10, shown in detail in the preferred embodiment of FIGS. 1–7, may be summarized in the following manner. Starting with FIG. 1, the wearer, or user, opens, or unzips, zipper 18 so that the interior of the jacket is visible. As shown in FIG. 2, liner 50 is adjustable so that it may fit snugly about the body of the wearer, particularly in the area of the sides, stomach and back. The liner is adjusted, as needed, by pressing the snap buttons 92, 94, and 96 into the selected receptacles 86, 88, 90 secured to straps 80, 82, and 84. The same procedure is followed by pressing buttons 110, 112, 115 into receptacles 104, 106, 108 on straps 98, 100, 102. By virtue of such adjustment, resilient insert 52 bears against the back of the wearer. The jacket is then zipped closed by drawing zipper 18 upwardly. Elastic section 76, shown in FIGS. 2 and 3, is drawn against the back of the wearer.

As shown in FIG. 3, the pleats 118, 120, 122, 124 provide additional clearance for the shoulders of the wearer, and allow unimpaired movement of the shoulders. After the liner 50 has been adjusted, and the jacket has been closed, the wearer then adjusts, or tightens, the cuffs 22, 28 about his wrists. Cuff 22 may be tightened by shifting the snap fasteners 140 on flap 142 toward snap receptacles 144 to reduce the diameter of the cuff; cuff 28 may be tightened by shifting the snap fastener 146 on flap 148 toward snap receptacles 150 to reduce the diameter of the cuff. By tightening the cuffs 22 and 28, properly adjusting the wristlets 24, 30, and adjusting the elastic section 76, the wearer has anchored the jacket 10, in a comfortable fashion, about his body and upon his arms. The wearer may then engage in any vigorous and/or strenuous activity that he wishes, and the jacket will remain fixed in place, and will not interfere with, or impede, such activity.

FIG. 2 shows the manner in which the movement of the body of the wearer is absorbed by the resilient, yieldable insert, and is not transmitted by the resilient, yieldable insert 52 to the side panels of the jacket. When the stress forces are terminated, insert 52 returns to its normal, unstressed position. Consequently, the jacket does not "bunch-up", or gather, particularly in the area of the stomach, and chest of the user, but remains flat and in contact with the body of the wearer.

FIG. 4 stresses that the cuffs 22, 28, which are actually "false" cuffs, are isolated from the forces acting upon inner liner 50 for the jacket. The cuffs 22, 28 are indirectly joined to the free ends of sleeves 20, 26 by gussets, such as gusset 132. A resilient band, such as band 134, is sewn between the interior of the cuff and the gusset.

In operation, after the wristlets 24, 30 are "set" on the wrists of the wearer, and the wearer swings his arms, such as by driving a golf ball, the wristlets 24, 30 move relative to the free ends of cuffs 22, 28. The pleats 118, 120, 122 and 124 expand to accommodate the swinging movement of the shoulders of the wearer. The initial two and a half to three inches of movement of the wristlet is achieved by drawing the gusset (such as gusset 132) outwardly, or by turning the gusset inside out, as shown, in sequence, in FIGS. 5 and 6. Continued movement of the arms of the wearer exerts a pull on the gusset and the resilient band (such as band 134) which is attached to the inner end of the gusset. The resilient characteristic of the band is selected so that the band will yield gradually, and will allow another 2–3 inches of travel for the wristlet before reaching its elastic limit. Thus, the combined action of the gusset and the restraining band for each wristlet will allow 5–6 inches of travel for each cuff, or false cuff, relative to the sleeve with which it is associated. Such extensive movement adequately compensates for strenuous movements encountered in vigorous athletic endeavors, and precludes the cuffs from "riding-up" the arms of the wearer of the jacket.

As the wearer returns his arms to their normal, by-his-side orientation, the gussets are pulled back inside the cuffs by the action of the retaining band. The so-called "piston-and-cylinder" cuffs are thus self-restoring, and need not be tucked back into their normal position by the wearer. Such self-restoring capability enhances the neatness of the jacket, and insures the wearer that the cuffs are ready for repetition of an arm swinging movement in a fraction of a second; the repetition might be encountered when doing "jumping jacks" or other fast-paced aerobic exercises.

ALTERNATIVE EMBODIMENTS

Figure 8:
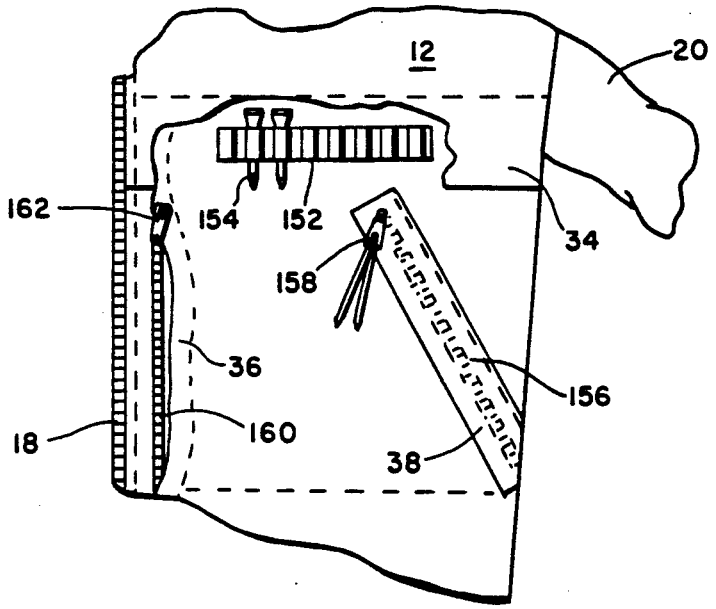
FIG. 8 is a front elevational view, on an enlarged scale, of one panel of the jacket of FIG. 1.
Figure 9:
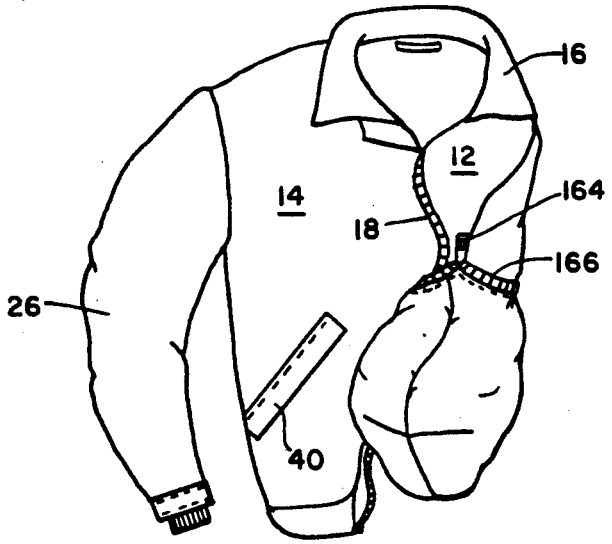
FIG. 9 is a perspective view of the jacket of FIG. 1, showing such jacket being inserted into a pouch.
Figure 10:
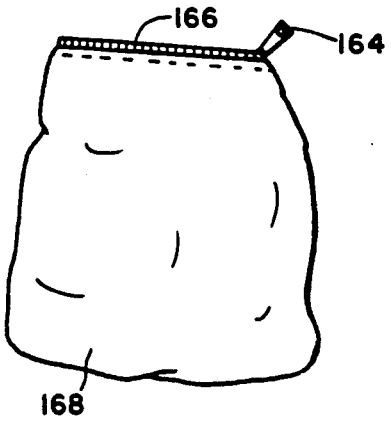
FIG 10 is a view of the pouch with the jacket contained therein.

While FIGS. 1–7 depict the preferred embodiment of the instant invention, FIGS. 8–10 show alternative embodiments and/or ancillary features thereof. For example, FIG. 8 depicts, on an enlarged scale, the details of the front panel 12 of jacket 10. A band of fabric 152, with a series of loops, is sewn onto the front panel of the jacket beneath flap 34. Golf tees 154 are inserted into the loops of the band.

A zipper 156 is visible beneath diagonal flap 38, and a slider 158 extends below the flap. The zipper provides access to a large internal pocket defined between the shell of the jacket and the inner liner sewn, or otherwise secured, thereto. Another zipper 160, and the slider 162, for opening and closing the vertically oriented zipper, are located beneath the vertical flap 36; here again, the zipper provides access to yet another pocket.

FIGS. 9 and 10 suggest another embodiment of the jacket 10 wherein a large zipper ;64, with a slider 166, is located on the front panel 12 of the jacket. The slider 164 opens the entire zipper, and the jacket is then turned inside-out and placed within the pocket, or pouch 168. After the jacket has been inverted, the slider 164 draws the zipper closed, and the jacket may be stored in a compact fashion.

While a preferred embodiment of the active-wear jacket has been shown in FIG. 1–7, and while other embodiments and/or refinements have been suggested in FIGS. 8–10, other modifications, revisions, and/or alterations, may occur to the skilled artisan in the useful arts and sciences to which this invention appertains. To illustrate, while the front panels of the outer garment may be secured together by zipper 18, the panels could be joined by Velcro fasteners, buttons, etc. Consequently, the appended claims should be broadly construed, in a manner consistent with the significant advance in the useful arts and sciences, and should not be limited to their literal terms.

I claim:

1. A garment suitable for wear during athletic activities comprising:

a) an outer shell formed of a material having sufficient porosity to allow perspiration vapor from the body of the wearer to escape therethrough, b) said shell comprising a first front panel, a second front panel, a back secured to said first and second panels and extending therebetween, and a pair of sleeves, c) each sleeve including a first and a second end, the first end being secured between one of said front panels and said back, the second end being a free end that hangs from said shell, d) a cylinder of waterproof material secured to the free end of each sleeve, e) a wristlet situated within said cylinder at the free end of each sleeve, f) the improvement comprising a gusset that is fastened between the free end of said cylinder and the inner end of said wristlet, and g) said gusset being turned inside out to permit unfettered travel as said wristlet move relative to said cylinder when the wearer of the garment moves his arms.

2. A garment as defined in claim 1 wherein the improvement further comprises a resilient bank secured between the free end of said sleeve and the inner end of said wristlet, said resilient bank urging said wristlet to a home position relative to said sleeve.

3. A garment as defined in claim 2 wherein said cylinder and said shell are formed of the same, light-weight material, and the invention is further characterized by forming said cylinder, said gusset, and said wristlet approximately equal in length.

4. A garment as defined in claim 2 wherein the invention is further characterized in that said gusset conceals said resilient band from view, said gusset being formed of a waterproof material.

5. A garment as defined in claim 1 wherein the invention is further characterized by said wristlet being formed of a ribbed fabric that securely grips the wrist of the wearer, and sets the sleeve in a fixed position.

* * * * *